United States Patent [19]

Charbonnier et al.

[11] Patent Number: 4,844,748

[45] Date of Patent: Jul. 4, 1989

[54] PROCESS FOR THE CHEMICAL SURFACE TREATMENT OF AN ALUMINOUS PRODUCT WITH A VIEW TO ITS PHOSPHATING

[75] Inventors: Jean-Claude Charbonnier, Chambourcy; Alain Roche, Saint Jean de Niost; Maurice Romand, Villeurbanne; Janine Lenoir, Chaponost; Eric Sahakian, Decines, all of France

[73] Assignee: Institut de Recherches de la Siderurgie Francaise (IRSID), Maizieres-les-Metz, France

[21] Appl. No.: 174,294

[22] Filed: Mar. 28, 1988

[30] Foreign Application Priority Data

Mar. 27, 1987 [FR] France ..... 87 04583

[51] Int. Cl.[4] ..... C23C 22/78

[52] U.S. Cl. ..... 148/254; 148/6.15 Z; 148/6.15 R; 134/2

[58] Field of Search ..... 252/156; 134/2; 148/6.15 R, 6.15 Z, 6.14 R

[56] References Cited

U.S. PATENT DOCUMENTS 4,762,638 8/1988 Dollmar ..... 252/156

*Primary Examiner*—Sam Silverberg

*Attorney, Agent, or Firm*—Pollock, Vande Sande & Priddy

[57] ABSTRACT

This process for treating surfaces of products dip-coated in a bath of molten zinc and aluminum, and intended to be phosphated, involves pickling, preceding the phosphating, with a highly alkaline solution of high pH and containing zinc in solution. The process applies chiefly to products whose coating contains a high proportion of aluminum, particularly in the case of galvanized sheet metal, which it makes easier to phosphate. It is used for painted sheet metal for motor vehicles.

11 Claims, No Drawings

PROCESS FOR THE CHEMICAL SURFACE TREATMENT OF AN ALUMINOUS PRODUCT WITH A VIEW TO ITS PHOSPHATING

FIELD OF THE INVENTION

The present invention relates to the chemical surface treatment of a metallurgical product made of aluminum alloy, or even of technically pure aluminum. More particularly, the invention relates to such products forming a coating on a substrate which, in most cases, is a sheet of steel.

BACKGROUND OF THE INVENTION

The motor vehicle market in particular, is highly dependent on this kind of steel sheet which is coated on at least one face and is generally referred to as "galvanized", and this is above all because of its corrosion resistance which enables it to be used in this form. It also happens that it is intended to be painted, in which case a phosphating pretreatment is found to be necessary to ensure good paint adhesion.

Although the invention may be applied generally to monolithic products, such as aluminum sheets, for the sake of simplicity the following will be directed to only steel sheets coated with a layer of a compound of the "zinc-aluminum" type, this, being doubtless the most common case.

It is known that these aluminous compounds comprise, on the surface, a thin film of oxide of these metals, and particularly of alumina, which forms naturally. The presence of these oxides on the surface interferes with the subsequent surface treatment operations to which the sheet metal may be subjected, and especially the phosphating operation.

It has been found, in particular, that it was difficult to obtain a correct phosphating, and sometimes even that phosphating was impossible, when the aluminum content of the coating was high.

For example, it has been possible to establish that steel sheet coated with a Zn-Al alloy containing 5% of aluminum could be phosphated correctly only if fluoride ions were added to the phosphating bath (cf. French patent Application No. 2,575,188).

In the case of a zinc-aluminum coating with a higher content of aluminium, for example of the order of 55% and above, phosphating was not being produced at all in a bath free from fluorine and, in a bath which contained it, the phosphate layer formed on the aluminum-rich coating was highly heterogeneous and porous.

French Patent Application No. 2,567,158 describes a process for the preparation of a steel product galvanized hot by dipping in a bath containing zinc or a Zn-Al alloy, and intended to be phosphated. This process consists in forming on the product an electrolytic deposit of a metal chosen from a specific group of metals, it being possible for this metal, in particular, to be zinc. According to this document, the zinc layer deposited in this manner on the film of oxides which was formed on the surface of the coating makes it possible to ensure better anchoring of the phosphate layer which is subsequently deposited.

However, from an industrial standpoint, the process of electrolytic deposition in an acidic medium, described below, has the disadvantage of requiring a modification of the conventional phosphating line assembly, because of the introduction of an additional treatment involving the use of an electrolysis vessel, and of its electrical supply.

What is more, as indicated in the above-mentioned document, the electrolytic deposition is preceded by an electrolytic pickling (electrochemical polishing) bath which is necessary to remove the oxide layer formed on the surface without contaminating the zinc deposition bath. It will readily be understood that, because of the two electrolytic baths, this process is a particularly high consumer of electrical energy, and this represents a major disadvantage from the standpoint of economics.

British Patent Application No. 2,152,955, also describes a process for the treatment of metal sheets coated with a zinc-aluminum alloy with a view to facilitating a subsequent phosphating operation. According to this process, the metal sheet is treated in an alkaline solution intended to strip off the aluminum present on the surface. However, as the examples described show, the coating of the treated metal sheets is relatively poor in aluminum (less than 10%).

Furthermore, the solution employed contains ions of at least one of the following metals: nickel, iron, cobalt and manganese. These metals can deposit on the surface of the coating and, although they tend to facilitate the subsequent phosphating, they form a heterogeneous surface layer with the zinc of the coating. Electrochemical phenomena (cell phenomena between different metals) can be produced within this layer, leading to a subsequent deterioration of the latter.

SUMMARY OF THE INVENTION

An object of the present invention is to facilitate the phosphating of an aluminous coating, and more particularly of a coating with a high aluminum content, while avoiding the phenomena described above.

Another object is to improve the anchoring and the behavior of the phosphate layer which is deposited subsequently during the phosphating.

A still further object is to provide the pretreatment beofre phosphating at a reduced cost.

More precisely, the object of the invention is to produce on the coating which is intended to be phosphated a deposit of metal other than aluminum, and especially zinc, having properties of anchoring the phosphates, this deposit being sufficient to ensure good anchoring of the phosphate layer which is subsequently deposited.

With these objects in view, the subject of the present invention is a process for the surface treatment of an aluminous product intended to be subjected to a phosphating operation, in the course of which process the said product is covered with a layer of metal other than aluminum and possessing properties of anchoring the phosphates. To produce this layer of metal, a treatment of pickling the said product is carried out by means of a highly alkaline solution containing the said metal in solution.

According to a particular characteristic of the invention, the alkaline solution has a pH higher than 11, and preferably equal to at least 12.5.

According to another characteristic, the alkaline solution is a caustic soda liquor which contains at least five moles of NaOH per liter of water.

According to an additional characteristic, the treatment is carried out at a temperature of about 10° to 65° C., and preferably at ambient temperature (i.e., of the order of 15° to 20° C.).

According to yet another characteristic, the treatment is carried out for a sufficient time to obtain a deposit of metal in the form of a substantially continuous layer, the latter preferably having a thickness of approximately 1 μm.

Another subject of the invention is the application of the process described above to the phosphating of metal sheets dip-coated in a bath of molten metal containing a high proportion of aluminum. In this case, after an optional first degreasing of the sheet metal using solvents, it is passed, in accordance with the said process, through a highly alkaline degreasing bath containing the metal in solution and maintained at ambient temperature, and it is then passed through a cold rinsing bath, followed by a refining bath containing titanium or nickel, and then through the phosphating bath.

As will doubtless be understood, a crucial advantage of the process according to the invention is that it does not consume any electrical energy, and this makes it particularly advantageous economically. Furthermore, no major modification is necessary in order to adapt a conventional phosphating line to the process, since only the composition of the alkaline degreasing bath is modified.

In fact, it has been found, in the course of a study of the influence of the surface treatments of the galvanized coatings on the adhesion of paints, that, while the problems of phosphating metal sheets coated with Zn-Al alloys containing a high proportion of Al were well known, there was no need at all to resort to the costly processes of electrolytic deposition of zinc in order to solve these problems. It was found, in fact, that, in contrast to the electrolytic deposition of zinc in an acidic bath, the zinc deposit may be produced merely by passing the coated metal sheet to be phosphated through a highly basic pickling bath containing zinc in solution.

The results of the tests which have been carried out have shown that the rate of deposition and the thickness of the zinc layer thus formed depended essentially on the concentration of NaOH in the alkaline bath, the deposition being made easier when the pH of the bath is very high. The tests carried out have also made it possible to show that the zinc concentration in the bath affects the characteristics of the deposit: an increase in the quantity of zinc in solution makes the deposition easier and, to some extent, makes it possible to compensate for the effects of any possible decrease in the pH of the bath.

It must of course be understood, as explained in detail in the above-mentioned FR No. 2,567,158, that the result aimed at by the invention may be achieved by virtue of a surface deposition of zinc in metallic state onto the coating of the sheet metal, this metallic zinc making it possible to ensure the anchoring of the layer of phosphates, which are themselves generally zinc phosphates. However, attention must be drawn to the fact that phosphating takes place in an acidic medium (which would naturally tend to remove the zinc deposit) and that, in order to avoid an excessive attack on the said deposit, leading to stripping the underlying aluminum bare, the zinc deposit must be of sufficient thickness. Furthermore, the deposit must not be too thick, since the zinc deposited then tends to be pulverulent, and this would be detrimental to the adhesiveness of the phosphating layer. Allowing for a few non-uniformities due to the presence of the two metals zinc and aluminum as an underlying layer, a mean thickness of the order of 1 μm can be taken as an optimum.

It can also be assumed that the deposited zinc layer may be not absolutely continuous, that is to say that, if diminutive imperfections in this layer appear, they will not interfere with the nucleation of the phosphates during the phosphating operation, since these will insert themselves into possible imperfections in the zinc layer. This tolerance should not, of course, be stretched, otherwise the corrosion-protection properties of the product will be seen to deteriorate rapidly.

The inventors have tried to understand and to account for the surprising effect of the deposition of zinc in solution in an alkaline pickling bath on a Zn-Al substrate.

The hypothesis formulated is that the alkaline pickling (also known as degreasing) bath, to the extent that its pH is sufficiently high, attacks chemically the substantially continuous surface layer of alumina present on the surface of the Al-Zn alloy, as well as the layer of zinc and aluminum oxides lying immediately underneath, until the surface of the substrate is completely deoxidized. Metallic zinc and aluminum then appear, and these form two redox pairs with the zinc and aluminum stripped off in solution in ionic form. Because of the respective potential differences of these two pairs, the zinc in solution has a high tendency to redeposit onto the substrate and in particular onto the aluminum apparent on its surface, thus rapidly forming a continuous zinc layer. The dissolved aluminum remains in solution or may be complexed and deposited in the form of muds at the bottom of the bath.

It might be thought that the quantity of zinc dissolved by the basic attack on its oxide might be sufficient to reform the surface layer on depositing again onto the substrate. In fact, as has already been indicated before, the addition of zinc to the base solution of the pickling bath facilitates and speeds up the deposition and compensates for the effects of any possible decrease in the pH.

A more extensive study of the chemical reactions during the deposition would be necessary, however, to elucidate the observed phenomena completely.

It will be noted that, although the process according to the present invention employs the surface pickling of aluminum using an alkaline solution particularly as disclosed by GB No. 2,152,955, referred to already, it differs greatly in its principle. To begin with, it is important to recall that at high concentrations of alkaline agent, the pH of a solution does not represent the said concentration. In additin, it is liable to vary greatly during treatments such as those considered in this case, this being due particularly to the reactions taking place in the solution during the treatment and also to the carbonation resulting from the contact between the solution and the surrounding environment and the carbon oxides which it contains.

The inventors have been able to establish that, at the concentrations aimed at in GB No. 2,152,955 (1 to 60 g of sodium hydroxide per liter), the solution employed for pickling the coating would see its pH drop rapidly during the treatment, thereby greatly reducing the effectiveness of the pickling. However, these concentrations may be found sufficient to superficially pickle the alumina on the surface and to permit the deposition, on the remaining alumina, of metals such as Ni, Cr and Mn, which are present in the solution of ionic form.

On the other hand, the presence of residual alumina after a partial pickling would rule out the deposition of zinc thereon. The inventors have found, in fact, that, by virtue of a colution which has a very high concentration of alkaline agent (a normality of at least 5), it is possible to strip the coating until the alumina is removed and only metallic aluminum is left, in addition to the zinc of the coating, and this could not be achieved by means of the above-mentioned prior art methods. This, therefore, permits the deposition of the zinc remaining in solution (zinc added in the form of salt, or zinc dissolved as a result of the stripping of the coating). It will be possible, in particular, to employ a solution containing at least 200 g of NaOH per liter.

A primary advantage of this process is to provide a surface layer containing only zinc, which avoids the dissolution problems caused by the electrochemical phenomena outlined in the first part of this specification.

By way of example, a more precise description will now be given of the process of phosphating a metal sheet, of the "Galvalume®" (registered trademark) type, coated by immersing the steel sheet when hot in bath of Zn-Al alloy containing 55% of Al and 1.6% of Si. As explained above, this coating, containing a high proportion of aluminum, presents difficulties in surface treatment. Now, this product, whose chief present applications are in the field of building construction and, to a lesser extent, motor vehicle construction, could see its use increase considerably in these fields of activity, as an appearance material, provided that it could be properly phosphated to guarantee good adhesion of finishing paints and lacquers.

It is to be noted, in particular, that the process according to the invention makes it possible to gain independence of the operations for protecting a face before galvanization, or for removing by scraping the layer deposited during the galvanization, operations which were necessary in order to produce the metal sheets galvanized on only one face, which are employed in these field of activity.

To this end, a phosphating process including the process for the surface treatment according to the invention comprises the following stages:

the metal sheet passes through a degreasing bath of the type containing solvents, in order to remove most of the surface oils or greases;

next, after a rinse bath, the metal sheet passes through an alkaline pickling bath (also commonly called a "degreasing" bath), this bath being strongly basic, with a pH higher than 12 such as, for example, a soda liquor containing 400 g of NaOH per liter of water. This bath contains, in aqueous solution, zinc introduced in the form of powdered zinc or zinc oxide, in a proportion of a few grams per liter. In contrast to conventional practice, stirring the bath by injecting air will be avoided, since this promotes carbonation of the bath and hence a decrease in its pH. Mechanical stirring, for example, will be preferred. For the same reason, exposure of the bath to free air will be avoided as much as possible, and similarly efforts will be made to minimize the concentration of carbonates in the bath water. Similarly, it may be preferable to choose a low bath temperature, and this will thus avoid carbonation of the bath and the associated decrease in pH. Since the duration of the treatment in the alkaline bath affects the thickness of the deposited layer of zinc, the treatment will be carried out for a time sufficient to obtain the deposition of a substantially continuous layer. In the case of a highly basic bath (400 g of caustic soda per liter of water), this time may, for example, be approximately 45 s;

the metal sheet is then rinsed in cold water;

it then passes through a surface-conditioning bath, known as a refining bath, containing titanium or nickel in solution, intended to facilitate the subsequent nucleation of the phosphates; and finally, it passes through the phosphating bath and then through the various baths for rinsing with water, chromic rinsing, stoving, and the like.

Quite obviously, the process described above does not limit the invention, and many alternative forms may be applied without departing from the scope covered by the invention. The invention can apply to any products or coatings comprising an alloy of zinc and aluminum, from low percentages of Al of the order of 5%, up to practically 100%, or pure aluminum. It is quite obvious, however, that the main advantage of the method is to be found in the case of the alloys containing a high proportion of aluminum, above approximately 50%.

The characteristics of the alkaline bath employed may also vary, with the limitation that the latter remains highly alkaline. It is possible, for example, not to employ a degreasing bath upstream of the alkaline bath, or to introduce non-ionic surfactants into the latter, it being possible, however, for this solution to introduce the risk of a rapid contamination of the alkaline degreasing (or pickling) bath.

Although the treatment at low temperature, close to the ambient, offers advantages in maintaining a high pH, while avoiding carbonation of the bath, it is possible nevertheless to increase the temperature up to approximately 60° or 65° C. without the risk of such carbonation as to rule out its use.

We claim:

1. Process for the chemical preparation of a surface of an aluminous product for subsequent phosphating, comprising the steps of (a) pickling said product by means of a highly alkaline solution having a normality of at least 5 and containing, in solution, a metal other than aluminum, said metal having phosphate - anchoring properties; and (b) covering said product with a layer of said metal.

2. Process according to claim 1, wherein said alkaline solution is an aqueous solution of sodium hydroxide.

3. Process according to claim 1, wherein said metal is zinc.

4. Process according to claim 1, wherein pickling is carried out at a temperature in the range of 10° to 65° C.

5. Process according to claim 3, wherein said zinc is introduced into the solution in the form of powdered zinc or zinc oxide.

6. Process according to claim 1, wherein pickling is carried out for a time sufficient to obtain a deposit of zinc in the form of a substantially continuous layer.

7. Process according to claim 6, wherein the deposited layer of zinc has a thickness of approximately 1 μm.

8. Process according to claim 1, wherein the alkaline solution contains non-ionic surfactants.

9. Process according to any one of claims 2 to 8 and 1, wherein said aluminum product is a metal sheet dip-coated in a bath of molten metal containing a high proportion of aluminum.

10. Process according to claim 9, including the step of passing said metal sheet (a) through a highly alkaline degreasing bath containing zinc in solution and maintained at ambient temperature, (b) then through a refining bath containing a metal selected from the group consisting of titanium and nickel, and (c) then through a phosphating bath.

11. Process according to claim 1, wherein said aluminous product is formed by coating an aluminum alloy on a sheet of steel.

* * * * *